US008915208B2

(12) United States Patent
Shanahan

(10) Patent No.: US 8,915,208 B2
(45) Date of Patent: Dec. 23, 2014

(54) MAGNETIC FLAG

(75) Inventor: Patricia Malley Shanahan, Naples, FL (US)

(73) Assignee: 1614 Group, Inc., Naples, FL (US)

( * ) Notice: Subject to any disclaimer, the term of this patent is extended or adjusted under 35 U.S.C. 154(b) by 461 days.

(21) Appl. No.: 13/217,740

(22) Filed: Aug. 25, 2011

(65) Prior Publication Data

US 2012/0285367 A1 Nov. 15, 2012

Related U.S. Application Data

(60) Provisional application No. 61/518,640, filed on May 9, 2011.

(51) Int. Cl.
*G09F 17/00* (2006.01)
*G09F 21/04* (2006.01)

(52) U.S. Cl.
CPC ..... *G09F 17/00* (2013.01); *G09F 21/04* (2013.01); *G09F 21/048* (2013.01); *G09F 2017/0075* (2013.01); *G09F 2021/041* (2013.01)
USPC ..... 116/173; 40/591; 40/600

(58) Field of Classification Search
USPC ..... 116/28 R, 173, 174, 175; 40/591, 592, 40/600, 621, 661.01; 160/DIG. 2, DIG. 16; 248/309.4, 467, 537, 683; D11/165, D11/166, 181
See application file for complete search history.

(56) References Cited

U.S. PATENT DOCUMENTS

| | | | | |
|---|---|---|---|---|
| 2,595,833 | A * | 5/1952 | Flaherty | 160/369 |
| 2,639,751 | A * | 5/1953 | Flaherty | 150/166 |
| 2,957,261 | A * | 10/1960 | Moskowitz | 40/600 |
| 3,124,501 | A * | 3/1964 | Wise | 428/167 |
| 3,144,274 | A * | 8/1964 | Harris | 297/481 |
| 3,161,932 | A * | 12/1964 | Seymour | 24/303 |
| 3,430,376 | A * | 3/1969 | Fritz et al. | 40/209 |
| 3,797,151 | A * | 3/1974 | Dexter | 40/592 |
| 4,139,233 | A * | 2/1979 | Bott | 296/200 |
| 5,226,792 | A | 7/1993 | Darago | |
| 5,398,437 | A * | 3/1995 | Bump et al. | 40/582 |
| 6,213,440 | B1 * | 4/2001 | Kornback | 248/514 |
| 6,412,116 | B1 * | 7/2002 | Clark | 2/129 |
| 6,742,295 | B2 * | 6/2004 | Gross | 40/711 |
| 7,086,092 | B1 * | 8/2006 | Cruz | 2/132 |
| 7,187,261 | B2 * | 3/2007 | Cassar | 335/306 |
| 7,987,808 | B1 * | 8/2011 | Evans | 116/28 R |
| 8,499,943 | B1 * | 8/2013 | Neldner | 211/70.6 |
| 2003/0217685 | A1 * | 11/2003 | Aldridge | 116/173 |
| 2004/0134108 | A1 | 7/2004 | Harari | |
| 2011/0131742 | A1 * | 6/2011 | Cheung | 15/210.1 |

FOREIGN PATENT DOCUMENTS

| | | | | |
|---|---|---|---|---|
| NL | 1011752 | 5/1999 | | |
| WO | WO 2005058087 A1 * | 6/2005 | | A44B 21/00 |

OTHER PUBLICATIONS

International Search Report and Written Opinion for PCT Application No. PCT/US2011/049114 mailed on Sep. 26, 2011.
International Preliminary Report on Patentability for PCT Application No. PCT/US2011/049114 mailed on Nov. 21, 2013.

* cited by examiner

*Primary Examiner* — R. A. Smith
(74) *Attorney, Agent, or Firm* — Carlson, Gaskey & Olds, P.C.

(57) ABSTRACT

A magnetic flag includes a piece of flexible material having a first edge and a second edge and at least one magnet located near the first edge of the piece of flexible material. The second edge is unattached to the object. The at least one magnet is attachable to an object to removably secure the piece of flexible material to the object.

17 Claims, 10 Drawing Sheets

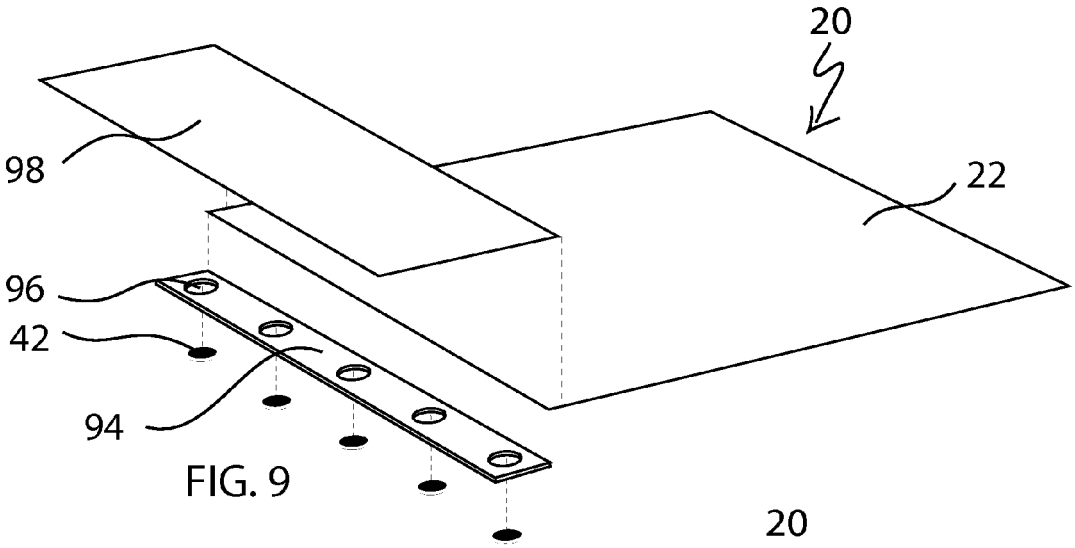
FIG. 9
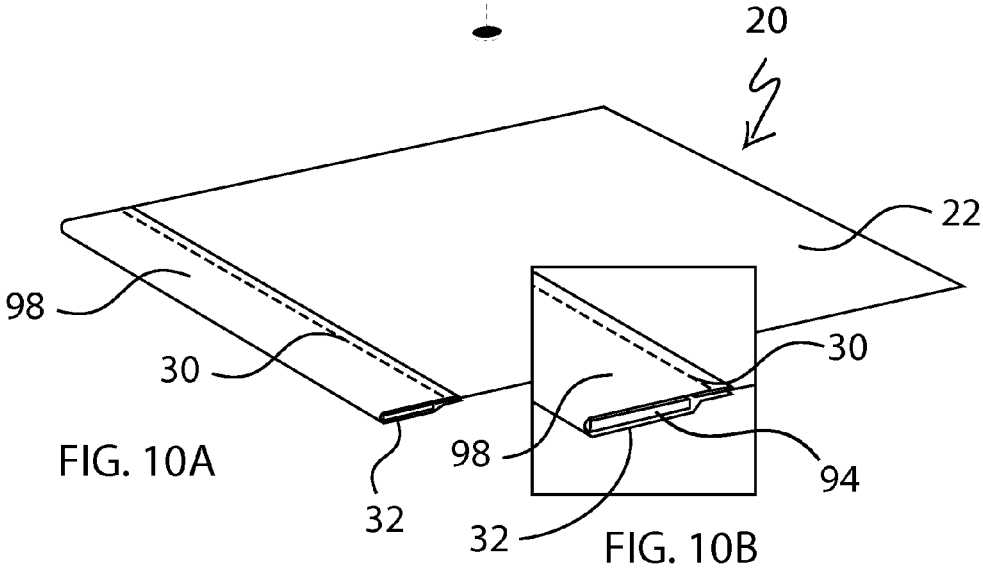
FIG. 10A
FIG. 10B
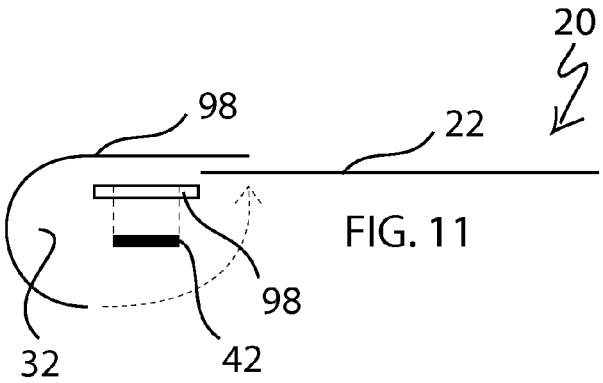
FIG. 11
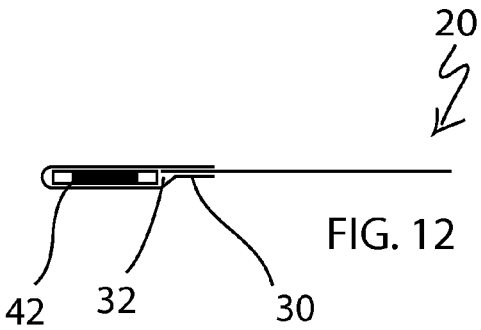
FIG. 12

MAGNETIC FLAG

REFERENCE TO RELATED APPLICATIONS

This application claims priority to United States Provisional Patent Application No. 61/518,640 filed May 9, 2011.

BACKGROUND OF THE INVENTION

Vehicles can be personalized in several ways, for example, by using vanity license plates, bumper stickers, pole flags attached to a car window (which can deform a rubber gasket around the car window), magnetic sheet signs, and other novelty items. The personalized object can display an individual's personality, provide decoration (such as for the holidays) or convey a theme or message, such as an interest in specific recreational and/or sporting teams, business signs and advertisements, and political views. The personalized object can also be used to send a message, for example, the object can have a bright or reflective surface to indicate an emergency or the need for assistance.

SUMMARY OF THE INVENTION

A magnetic flag includes a piece of flexible material having a first edge and a second edge and at least one magnet located near the first edge of the piece of flexible material. The second edge is unattached to the object. The at least one magnet is attachable to an object to removably secure the piece of flexible material to the object.

In another example, a magnetic flag includes a piece of fabric having a first edge and a second edge, and the piece of fabric includes a pocket defined by a folded-over portion of the piece of fabric that receives at least one magnet. The at least one magnet is located near the first edge of the piece of fabric, and the at least one magnet is attachable to an object to removably secure the fabric to the object. The second edge is unattached to the object. The magnetic flag also includes a spine located in the pocket having at least one recess. The at least one magnet is received in the at least one recess.

These and other features of the present invention can be best understood from the following specification and drawings, the following of which is a brief description.

BRIEF DESCRIPTION OF THE DRAWINGS

FIG. 9 illustrates an exploded perspective view of another embodiment of a magnetic flag;

FIG. 10A illustrates a perspective view of the magnetic flag of FIG. 9;

FIG. 10B illustrates an enlarged view of a portion of the magnetic flag of FIG. 10A;

FIG. 11 illustrates an exploded cross-sectional view of the spine being assembled in a pocket of the magnetic flag of FIG. 9;

FIG. 12 illustrates the spine assembled into the pocket of the magnetic flag of FIG. 9;

DETAILED DESCRIPTION OF THE PREFERRED EMBODIMENTS

Figure 1:
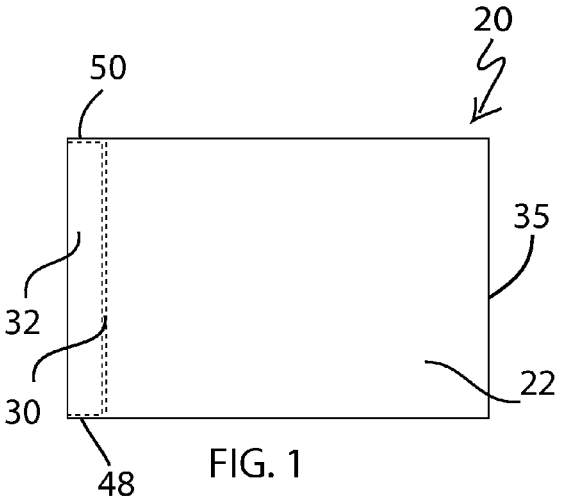
FIG. 1 illustrates a front view of a first embodiment of a magnetic flag.

FIG. 1 illustrates a front view of a magnetic flag 20. The magnetic flag 20 includes a piece of flexible material 22 and a pocket 32. The flexible material 22 includes a first side edge 33 and an opposing second side edge 35. The flexible material 22 can be fabric, plastic, or any material that is flexible. In one example, the flexible material 22 is water resistant, such polyester or nylon. The flexible material 22 can be made of more than one material. The flexible material 22 can also have any shape or size. For example, the flexible material 22 can be rectangular, triangular, or any other shape (for example, the flexible material 22 can be shaped to be a banner, a pennant or a streamer).

Figure 2:
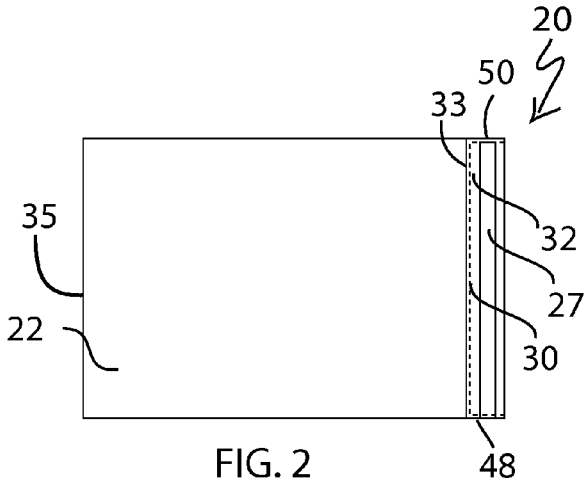
FIG. 2 illustrates a rear view of the magnetic flag of FIG. 1.
Figure 6:
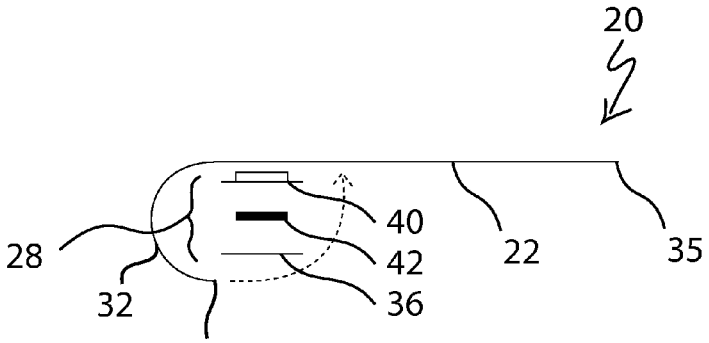
FIG. 6 illustrates an exploded cross-sectional view of the spine being assembled in a pocket of the magnetic flag of FIG. 1.
Figure 7:
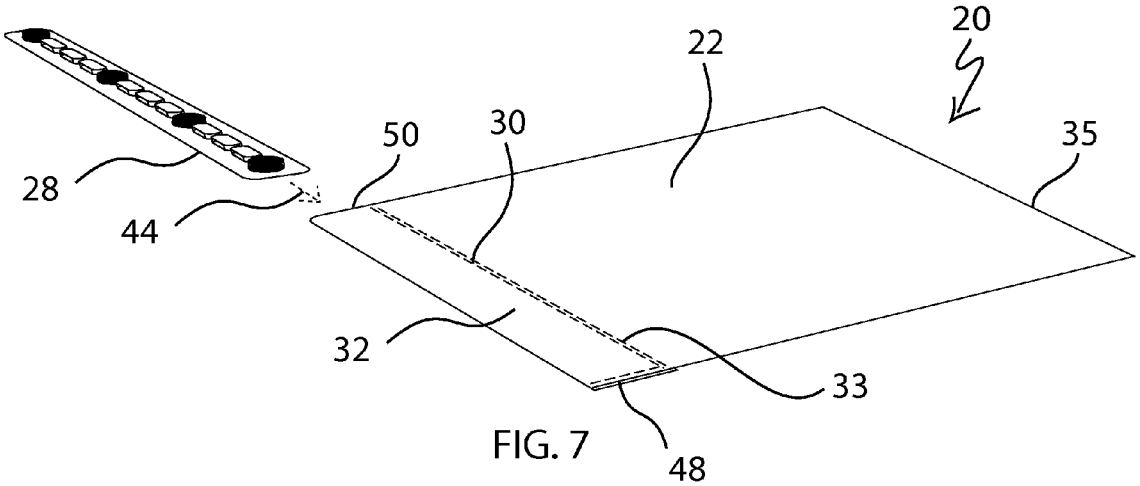
FIG. 7 illustrates assembly of the spine into the pocket of the magnetic flag of FIG. 1.

As shown in FIG. 2, a strip of non-skid material 27 can be received on a rear side of the pocket 32 of the magnetic flag 20. The strip of non-skid material 27 can be made of plastic, rubber or any other non-skid material. The pocket 32 is created by folding a portion of the flexible material 22 on itself (as shown in FIGS. 6 and 7) and then sewing a stitching 30 along the first side edge 33 and along a portion of a bottom edge 48 to create a pocket 32 that retains a spine 28.

Figure 3:
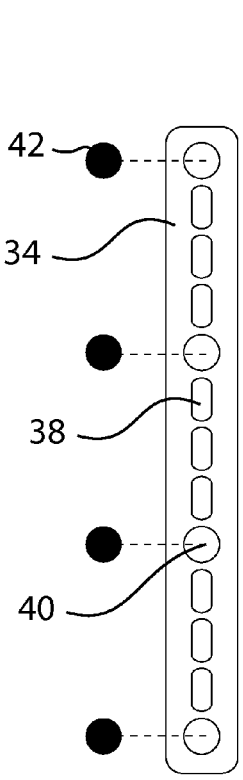
FIG. 3 illustrates a rear view of a spine of the magnetic flag of FIG. 1.
Figure 4:
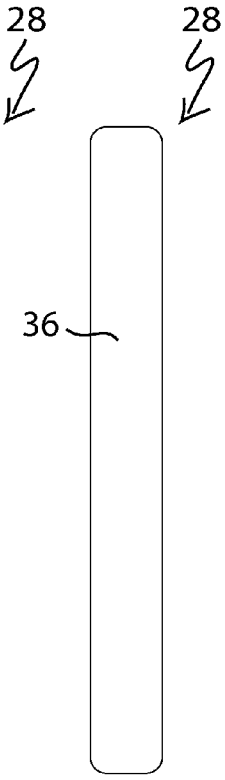
FIG. 4 illustrates a front view of the spine of FIG. 3.

FIGS. 3 to 4 illustrate the spine 28. The spine 28 includes a rear portion 34 and a front cover 36. In one example, the spine 28 is made of vacuum formed plastic and is semi-rigid. The spine 28 includes at least one bubble 38 filled with air. In one example, the at least one bubble 38 is vacuum formed. In one example, the spine 28 includes eight bubbles 38. The spine 28 also includes at least one recess 40 that holds a magnet 42. In one example, the at least one recess 40 is vacuum formed. In one example, the spine 28 includes four recesses 40 and four magnets 42. However, any number of recesses 40 and magnets 42 can be employed. The spine 28 can be made of any material, have any shape, size, or thickness. If more than one magnet 42 is employed, the spine 28 separates the magnets 42 and provides rigidity. The spine 28 is received in the pocket 32, and the at least one magnet 42 secures the magnetic flag 20 to an object, such as vehicle 26 (shown in FIGS. 33 and 34). The spine 28 can also be injection molded, stamped, or formed by a poured mold process. The spine can also be formed as the below-described spine 94.

In one example, the at least one magnet 42 is circular. However, the at least one magnet 42 can have any shape, such as square, rectangular, oval, triangular, etc. In one example, the object, such as a vehicle 26, is made of ferrous metal, such as iron, steel, nickel and/or cobalt. The at least one magnet 42 is a permanent magnet, for example, the magnet 42 is made of rare earth elements, ceramic, or ferrite. The at least one magnet 42 has sufficient strength to retain the magnetic flag 20 to the vehicle 26 or other object under high speeds. In one example, the at least one magnet 42 has a pull force between 1 to 15 pounds. Any type of magnet 42 with sufficient strength to hold the magnetic flag 20 to the object can be employed.

Although the spine 28 is illustrated and described as being located in the pocket 32 of the magnetic flag 20, another spine 28 or additional magnets 42 can be located along the second side edge 35 or along any other edge 48 or 50 of the magnetic flag 20.

Figure 5:
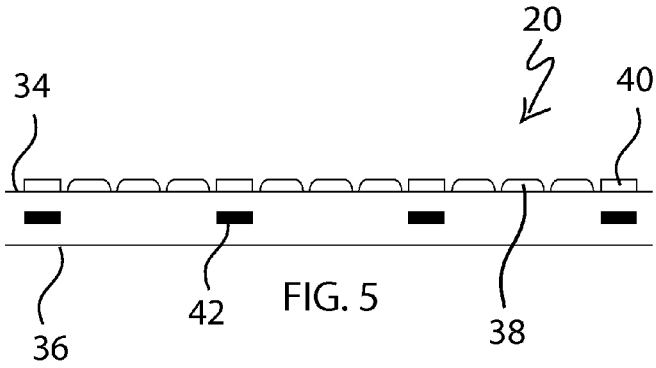
FIG. 5 illustrates a side exploded view of the spine of FIG. 3.

As shown in FIG. 5, each of the at least one magnet 42 is aligned with one of the at least one recess 40 in the rear portion 34. The front cover 36 is employed to retain the at least one magnet 42 in the at least one recess 40. In one example, the front cover 36 and the rear portion 34 are made of plastic and are semi-rigid.

FIG. 6 illustrates a cross-sectional exploded view of the spine 28 assembled into the pocket 32. As shown in FIG. 7, the spine 28 is slid in the direction of an arrow 44 into the pocket 32 formed by the stitching 30 located along the first side edge 33 and the portion of the bottom edge 48.

Figure 8:
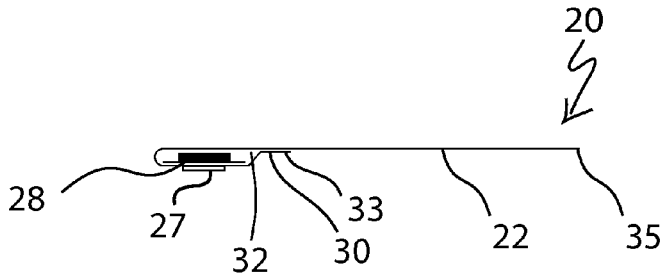
FIG. 8 illustrates the spine assembled in the pocket of the magnetic flag of FIG. 1.
Figure 13:
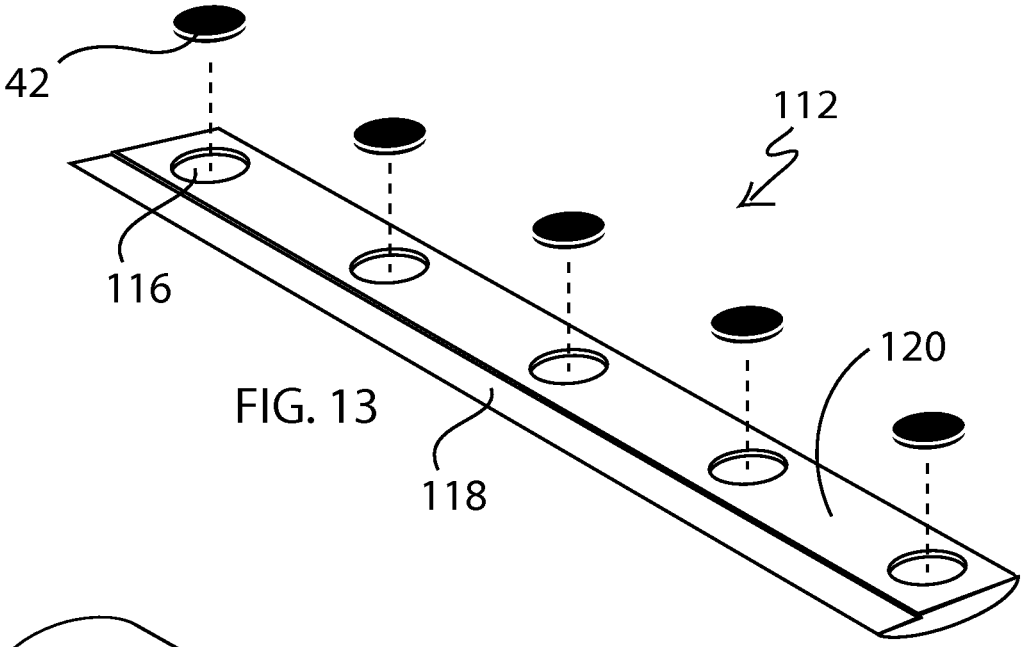
FIG. 13 illustrates a perspective exploded bottom view of another example spine.
Figure 14A:
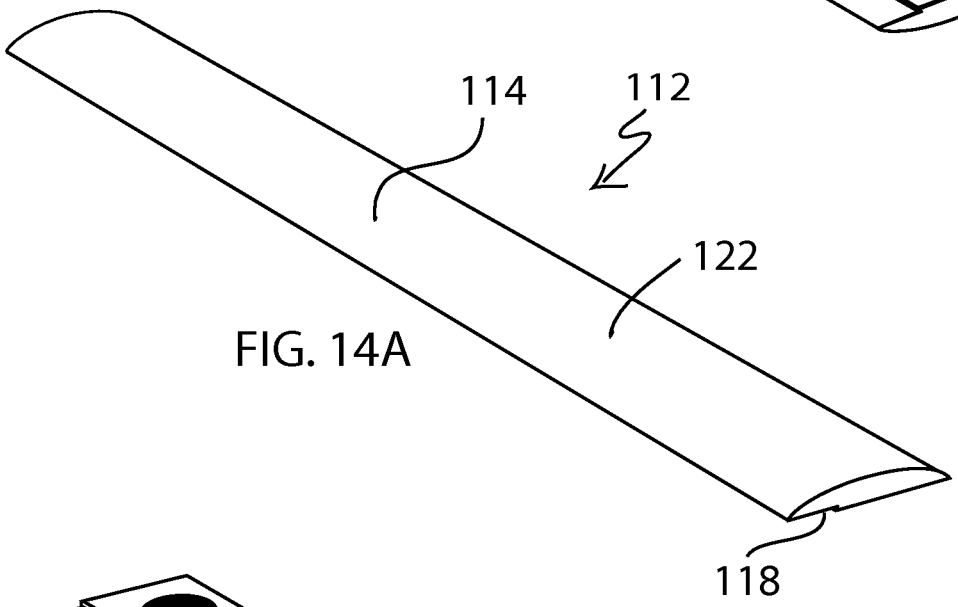
FIG. 14A illustrates a perspective top view of the spine of FIG. 13.
Figure 14B:
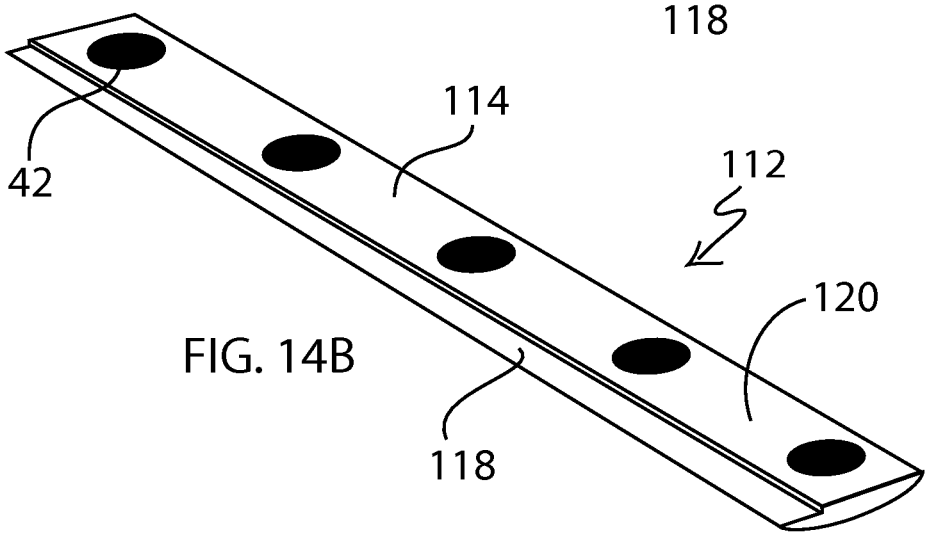
FIG. 14B illustrates a perspective bottom view of the spine of FIG. 13.

FIG. 8 illustrates a cross-section of the spine 28 once inserted into the pocket 32 of the magnetic flag 20. Once the spine 28 is inserted, a stitching 30 can be sewn near a portion of the top edge 50 to retain the spine 28 in the pocket 32. The spine 28 including the at least one magnet 42 can then be used to non-permanently attach the flexible material 22 to a metal object, such as a vehicle 26.

FIG. 9 illustrates another embodiment of the magnetic flag 20 including another example pocket 32. A spine 94 includes at least one aperture 96 that receives a magnet 42. Tape (not shown) is then wrapped around the spine 94 to retain the magnet 42 in the at least one aperture 96 of the spine 94. In one example, the spine 94 is formed of rubber and is flexible. The spine 94 can be injection molded, vacuum formed, stamped, or formed by a poured mold process. The spine can also be formed as the above-described spine 28.

In one example, the pocket 32 is formed as described above in reference to FIGS. 1 to 8. However, the pocket 32 can also be formed by a separate piece of flexible material 98. In one example, the flexible material 22 and the flexible material 98 are the same material.

As shown in FIGS. 10A, 10B, 11 and 12, the spine 94 including the at least one magnet 42 is placed under flexible material 98, and the flexible material 98 is wrapped around and folded over the spine 94 (shown in FIGS. 11 and 12). The edge 33 of the flexible material 22 is then received between the folded over portions of the flexible material 98. Stitching 30 is then sewed around the spine 94 and the three layers of overlapping material to attach the flexible material 98 to the flexible material 22 and retain the spine 94 in the pocket 32. The spine 94 can then be used to non-permanently attach the flexible material 22 to a metal object, such as a vehicle 26.

FIGS. 13, 14A, 14B, 15A, 15B, 16A and 16B illustrate another embodiment of a magnetic flag 110 and a flexible spine 112 secured to the flexible material 22 with an adhesive, such as a glue. The flexible spine 112 includes a spine body portion 114 including a flat inner surface 120 at least one magnet receiving recess 116 and an elongated notched portion 118 extending along the length of the flexible spine 112 and sized to receive the edge 33 of the flexible material 22. A magnet 42 is received in the at least one magnet receiving recess 116. The spine body portion 114 can include a plurality of magnet receiving recesses 116 that each receive a magnet 42. In one example, the magnet 42 is secured in the at least one magnet receiving recess 116 with an adhesive, such as glue. The flexible spine 112 also includes a curved outer surface 122 opposite to the flat inner surface 120 (shown in FIG. 14A). The spine 112 can be made of rubber or plastic. The spine 112 can be injection molded, vacuum formed, stamped, or formed by a poured mold process.

Figure 15A:
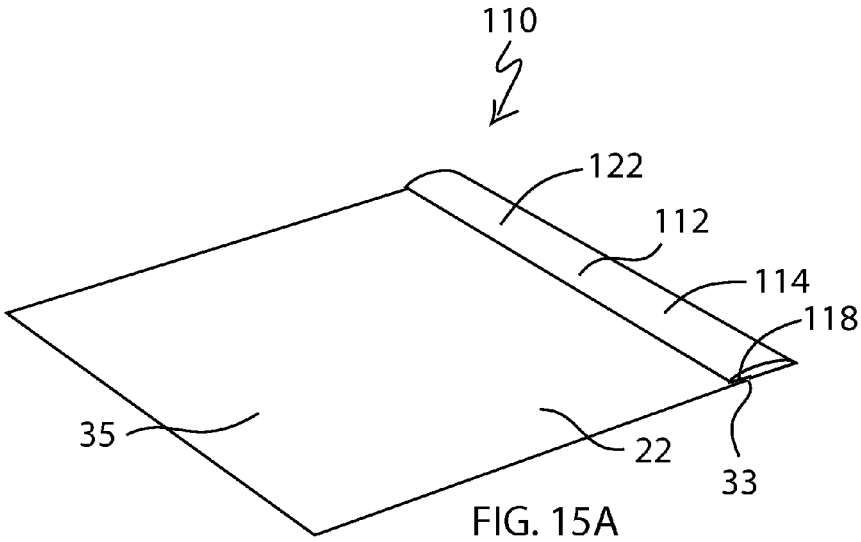
FIG. 15A illustrates a top perspective top view of a magnetic flag including the spine of FIG. 13 assembled on the flexible fabric.
Figure 15B:
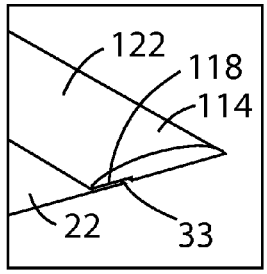
FIG. 15B illustrates an enlarged view of a portion of FIG. 15A.
Figure 16A:
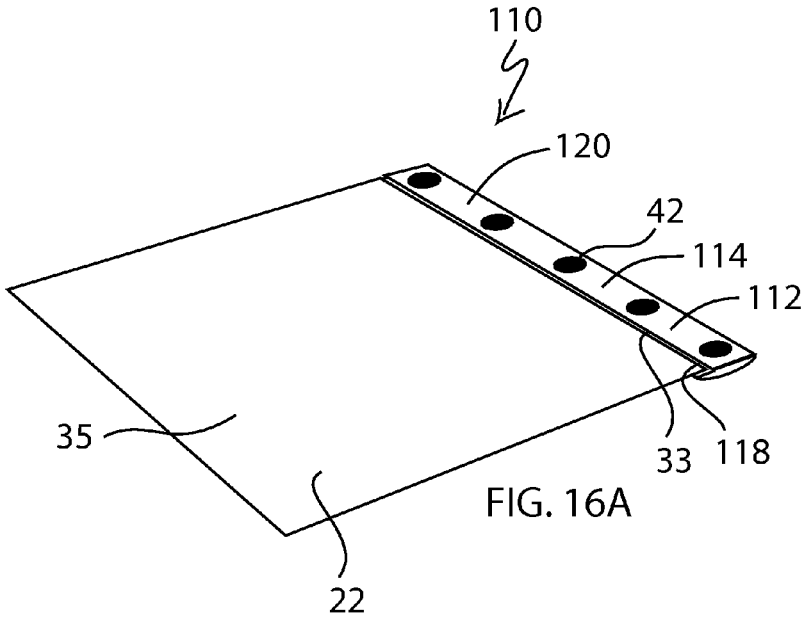
FIG. 16A illustrates a perspective bottom view of a magnetic flag including the spine of FIG. 13 assembled on the flexible fabric.
Figure 16B:
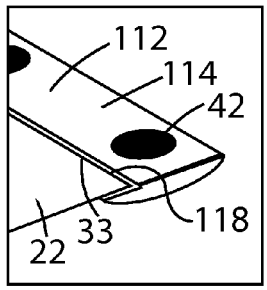
FIG. 16B illustrates an enlarged view of a portion of FIG. 16A.

FIGS. 15A and 15B illustrate a top view of a magnetic flag 110, and FIGS. 16A and 16B illustrate a bottom view of the magnetic flag 110. The edge 33 of the flexible material 22 is secured to the elongated notched portion 118 of the spine body portion 114 to define the magnetic flag 110. In one example, the edge 33 of the flexible material 22 is secured to the elongated notched portion 118 with an adhesive, such as glue. The flat inner surface 120 is placed on the object, such as the vehicle 26, to attach the magnetic flag 110 to the vehicle 26.

Figure 17:
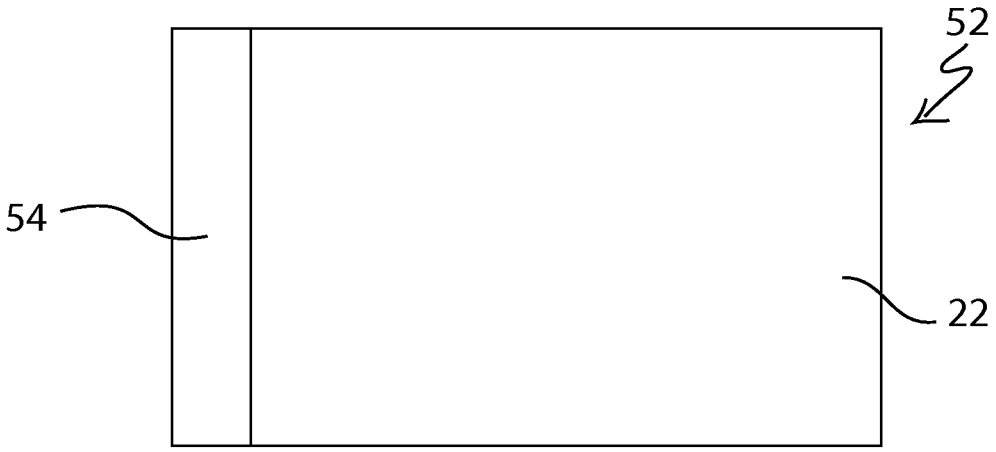
FIG. 17 illustrates a front view of another embodiment of a magnetic flag.

FIG. 17 illustrates another embodiment of a magnetic flag 52. The magnetic flag 52 includes the flexible material 22 and two spine segments 54 and 56 that together define a spine 51. In one example, the two spine segments 54 and 56 are made of rubber. Each spine segments 54 and 56 is sized and shaped to align with the edge 33 of the flexible material 22. The spine segments 54 and 56 can be injection molded, vacuum formed, stamped, or formed by a poured mold process.

Figure 18:
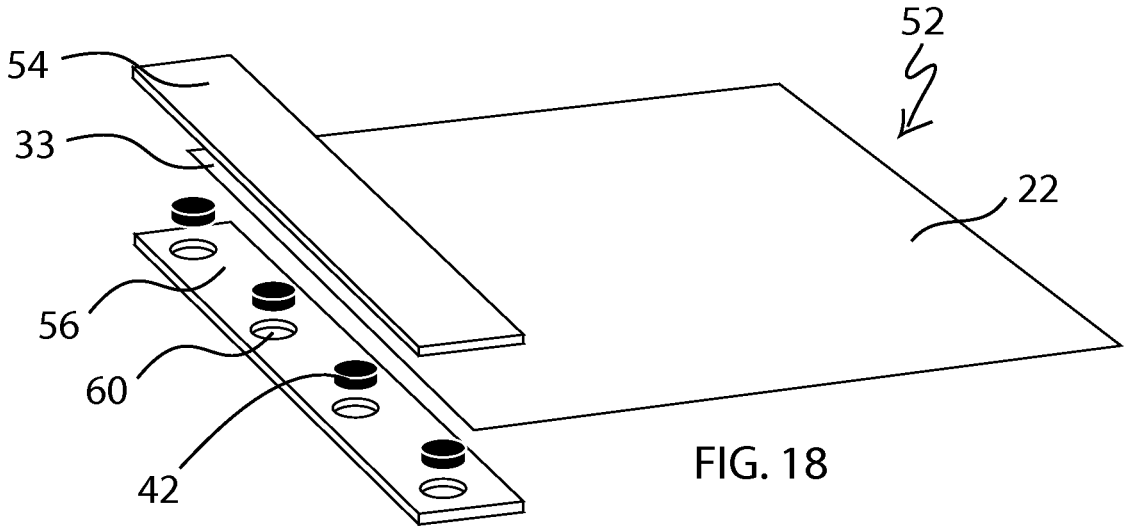
FIG. 18 illustrates a perspective view of the components of the magnetic flag of FIG. 17.
Figure 19:
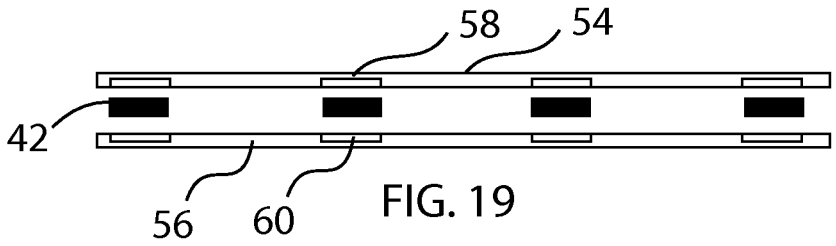
FIG. 19 illustrates an exploded side view of an exterior spine prior to assembly to the magnetic flag of FIG. 17.
Figure 20:
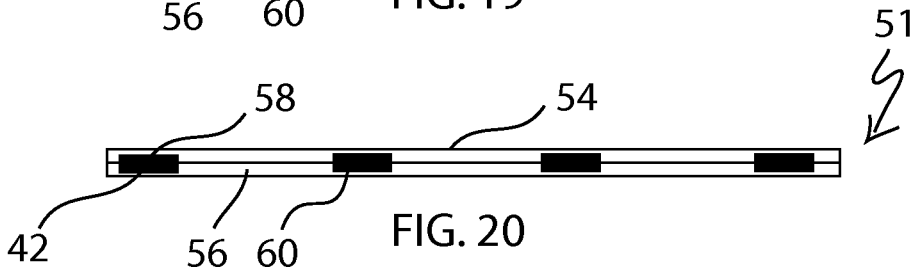
FIG. 20 illustrates a side view of the magnetic flag of FIG. 17 with the spine assembled.

As shown in FIGS. 18 to 20, the spine segment 54 includes at least one recess 58 that aligns with at least one recess 60 of the spine segment 56. In one example, the recesses 58 and 60 are circular. In one example, there are a plurality of recesses 58 and 60, and the number of magnets 42 is equal to the number of aligned recesses 58 and 60. A magnet 42 is located in the recess 60 of the spine segment 56. The flexible material 22, including the edge 33, is then placed over the spine segment 56. Once aligned, the spine segment 54 is positioned over the spine segment 56 and pushed down such that the magnet 42 is received in the at least one recess 58 of the spine segment 54. The spine segment 54 is located on a front surface of the magnetic flag 52, and the spine segment 56 is located on a rear surface of the magnetic flag 52.

Once the spine segments 54 and 56 are pressed together such that the magnet 42 is received in the recesses 58 and 60, respectively, the spine segments 54 and 56 are laminated to the flexible material 22 located between the spine segments 54 and 56 and therefore connected to define a spine 51. The spine 51 can then be used to non-permanently attach the flexible material 22 to a metal object, such as a vehicle 26.

Figure 21:
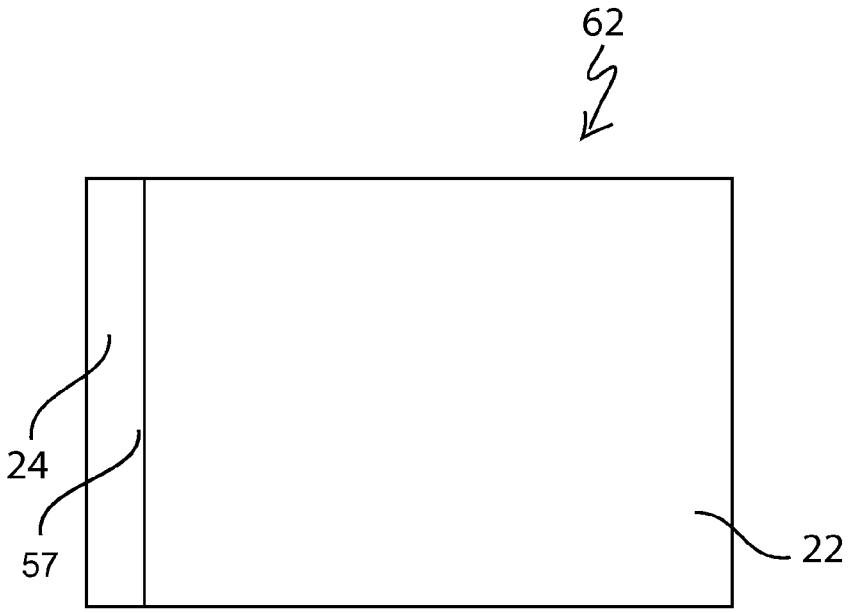
FIG. 21 illustrates a front view of another embodiment of a magnetic flag.
Figure 22:
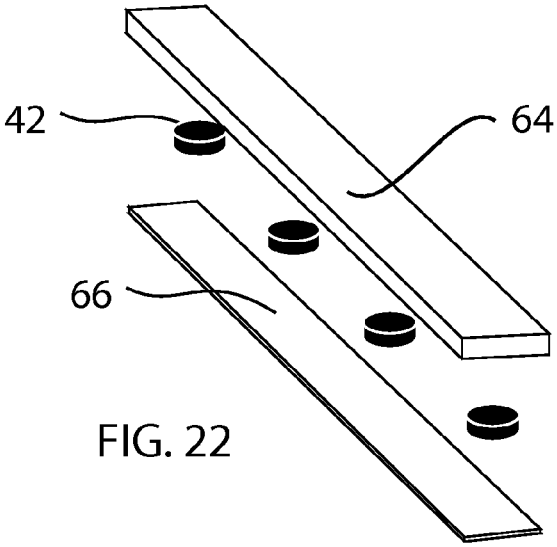
FIG. 22 illustrates a perspective view of the components of a spine of the magnetic flag of FIG. 21.
Figure 23:
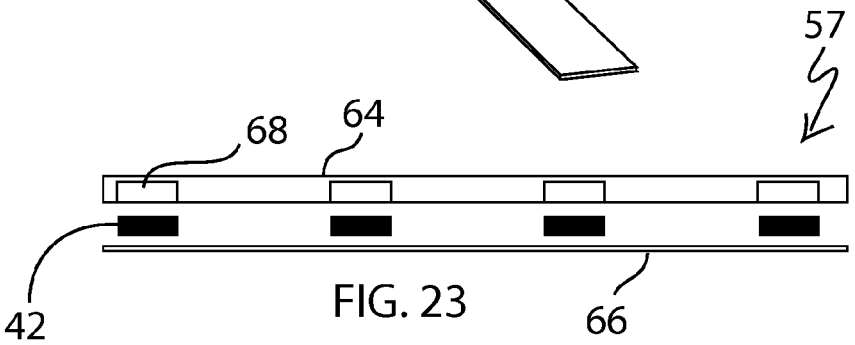
FIG. 23 illustrates an exploded side view of the spine of FIG. 22 prior to assembly.
Figure 24:
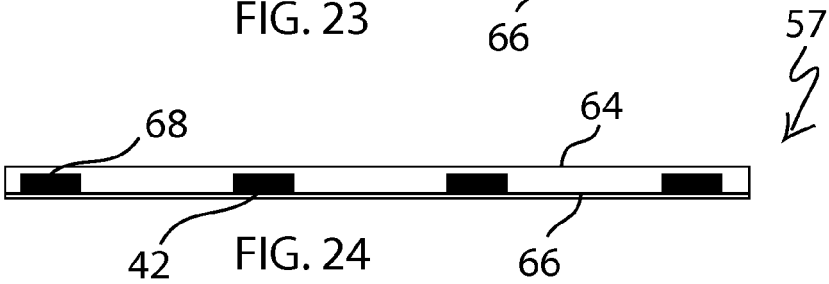
FIG. 24 illustrates a side view of the assembled spine of FIG. 22.

FIG. 21 illustrates another embodiment of a magnetic flag 62. The magnetic flag 62 includes the flexible material 22 and two spine segments 64 and 66. As shown in FIGS. 22 to 24, the spine segment 64 includes at least one recess 68. In one example, the at least one recess 68 is circular. A magnet 42 is located in the recess 68 of the spine segment 64. The spine segment 64 can include more than one recess 68 and more than one magnet 42. The spine segment 66 is positioned under the spine segment 64 and laminated together such that the magnet 42 is retained within both spine segments 64 and 66 to define a spine 57. The spine 57 can be made of rubber or plastic. The spine 57 can be injection molded, vacuum formed, stamped, or formed by a poured mold process.

The spine 57 can then be used to non-permanently attach the flexible material 22 to a metal object, such as q vehicle 26, to define the magnetic flag 62. The flexible material 22 is placed in a desired location, and the spine 57 is positioned in a desired location on the flexible material 22. In one example, the spine 57 is located near the edge 33 of the flexible material 22. Once the spine 57 is positioned on the flexible material 22, magnetized pressure between the magnet 42 and the metal object retain the flexible material 22 in place. However, the at least one magnet 42 can be located near any edge of the flexible material 22.

In one example, the spine 57 and the flexible material 22 are not attached, but the spine 57 is placed over the flexible material 22 to retain the flexible material 22 in place. In another example, an adhesive, such as glue, can be used to secure the spine 57 to the flexible material 22 in a desired location.

Figure 25:
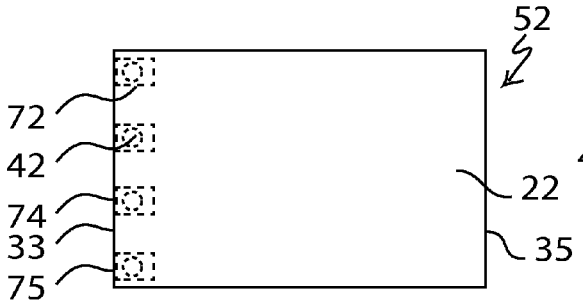
FIG. 25 illustrates a front view of another embodiment of a magnetic flag.

FIG. 25 illustrates another example of a magnetic flag 70. The flexible material 22 includes at least one pocket 72. In one example, the flexible material 22 includes a plurality of pockets 72. In one example, there are four pockets 72. A magnet 42 is received in each of the pockets 72. Once the magnet 42 is received in a pocket 72, the pocket 72 is sewn closed at the opening 74 with stitching 75, retaining the magnet 42 in the pocket 72.

Figure 26:
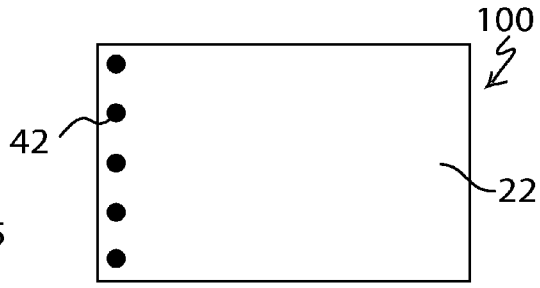
FIG. 26 illustrates a front view of another embodiment of a magnetic flag.
Figure 27:
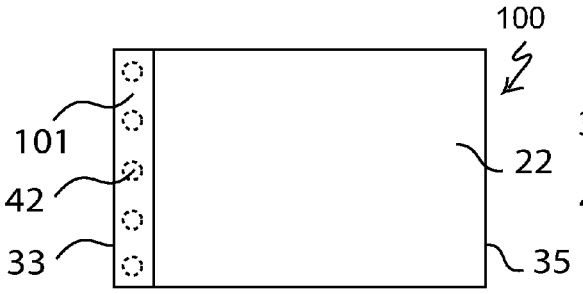
FIG. 27 illustrates a front view of another embodiment of the magnetic flag of FIG. 26.

As shown in FIG. 26, in another example magnetic flag 100, at least one magnet 42 is secured directly to the flexible material 22 using an adhesive, and the at least one magnet 42 removably attaches the flexible material 22 to a vehicle 26. In one example, the adhesive is glue. In one example, there are a plurality of magnets 42. As shown in FIG. 27, a portion of the flexible material 22 proximate to the edge 33 to which the at least one magnet 42 is attached is dipped in melted rubber. When hardened, the rubber 101 retains the at least one magnet 42 in position and protects the magnets 42 from atmospheric conditions. Additionally, the rubber 101 provides an anti-slip edge.

Figure 28:
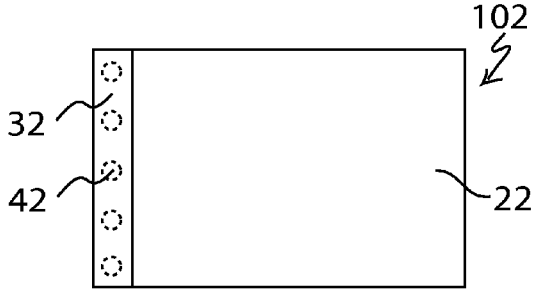
FIG. 28 illustrates a front view of another embodiment of a magnetic flag.

In another example shown in FIG. 28, the magnetic flag 102 includes at least one magnet 42 secured inside a pocket 32 that is formed in the manner described with respect to FIGS. 1 to 8 with an adhesive. In one example, the adhesive is glue. In one example, there are a plurality of magnets 42.

Figure 29A:
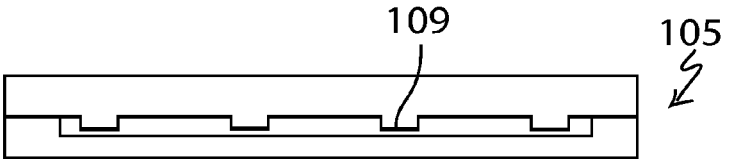
FIG. 29A illustrates a side cross-sectional view of an upper portion of a mold to form a spine.
Figure 29B:
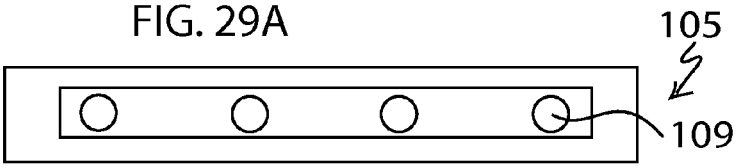
FIG. 29B illustrates a bottom view of the upper portion of the mold.
Figure 29C:
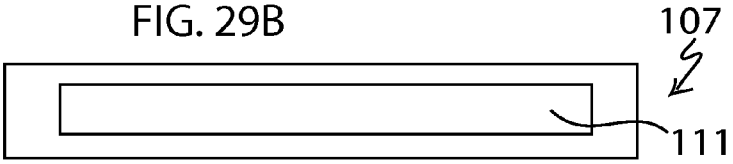
FIG. 29C illustrates a top view of a lower portion of the mold.
Figure 30A:
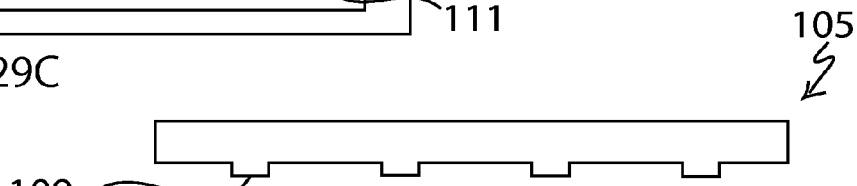
FIG. 30A illustrates a side view of the upper portion of the mold.
Figure 30B:
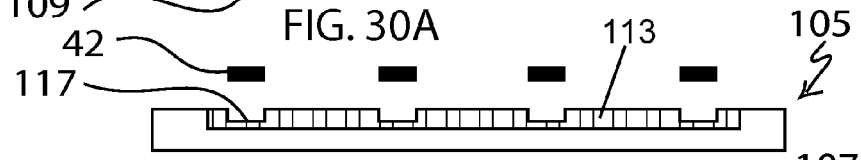
FIG. 30B illustrates a side exploded view of the lower portion of the mold with injected silicone and at least one magnet.
Figure 30C:
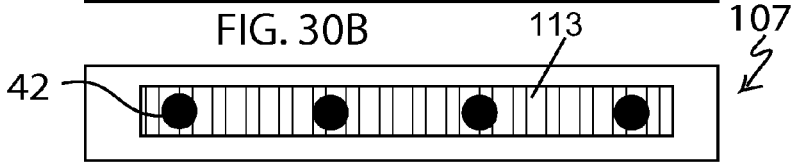
FIG. 30C illustrates a top view of the lower portion of the mold with the at least one magnet inserted into the silicone.

FIGS. 29A, 29B, 29C, 30A, 30B, 30C, 31A, 31B and 32 illustrate another example of a method of making a spine 103 including at least one magnet 42. As shown in FIGS. 29A and 29B, a mold includes an upper portion 105 including at least one projection 109 and a lower portion 107 including a recessed portion 111. In one example, the mold is made of steel. As shown in FIGS. 30A and 30B, silicone 113 is injected into the recessed portion 111 of the lower portion 107. While still soft, the upper portion 105 of the mold is positioned over the lower portion 105 of the mold and pressed down to create at least one recess 117 in the silicone 113 to hold each of the at least one magnet 42. As shown in FIG. 30C, the at least one magnet 42 is then inserted into the at least one recess 117 in the silicone 113.

Figure 31A:
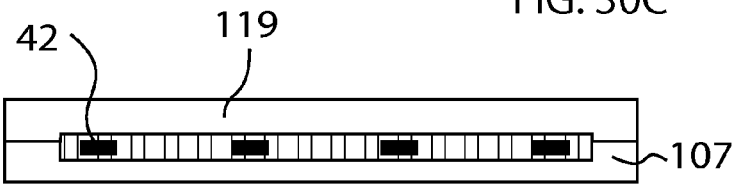
FIG. 31A illustrates a side view of another upper portion of the mold positioned over the lower portion.
Figure 31B:
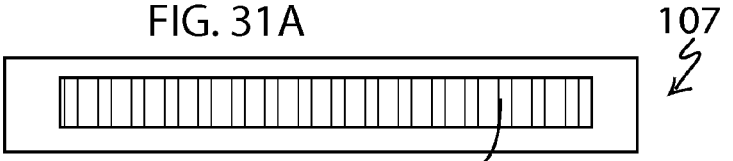
FIG. 31B illustrates a top view of the lower portion of the mold after a second injection of silicone.
Figure 32:
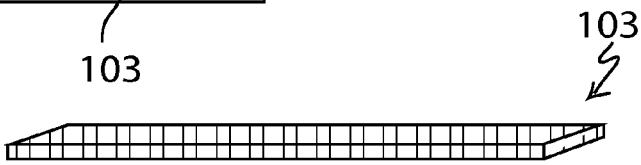
FIG. 32 illustrates the resulting spine formed from the mold.

As shown in FIGS. 31A, 31B and 31C, another upper portion 119 not including at least one projection is positioned over the lower portion 107, and silicone 113 is again injected to cover and embed the at least one magnet 42 within the silicone 113. As shown in FIG. 32, once the silicone 113 hardens, the resulting spine 103 including the at least one magnet 42 is formed and can be removed from the lower portion 107. The resulting spine 103 can be used with any of the above examples of magnetic flags.

Figure 33:
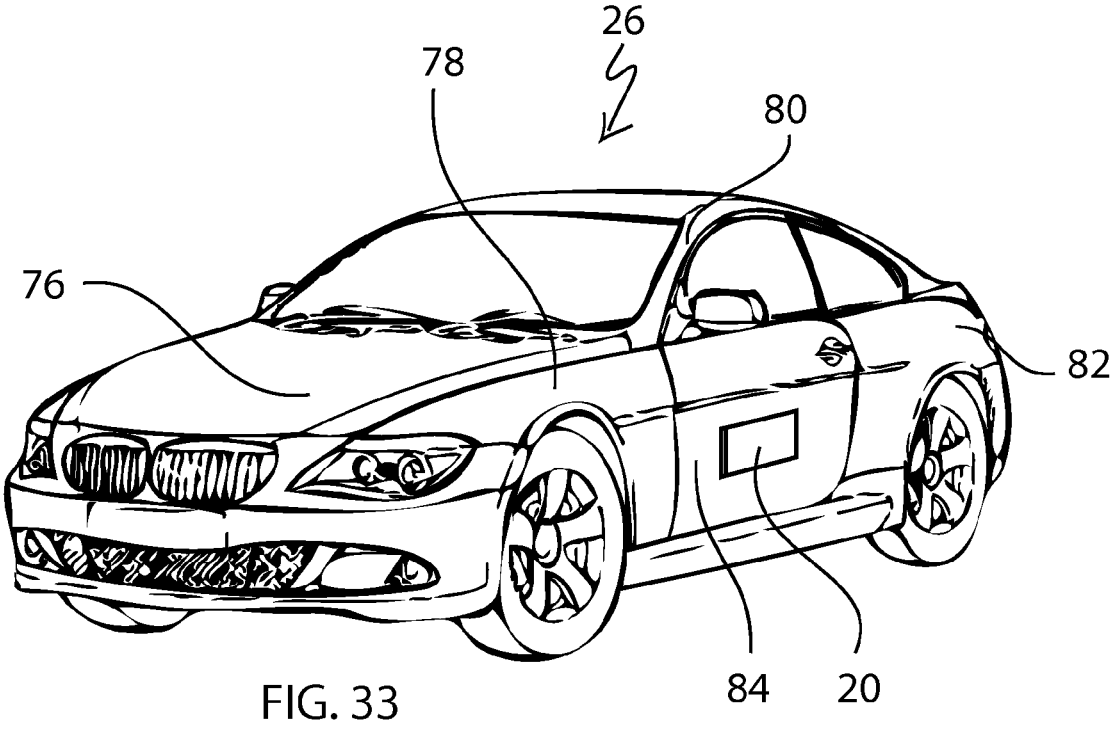
FIG. 33 illustrates a perspective view of a vehicle.

FIG. 33 illustrates the magnetic flag 20 (or any of the above-described magnetic flags) placed on a vehicle 26. In the example shown, the magnetic flag 20 is located on a vehicle door 84. However, the magnetic flag 20 can be positioned anywhere on the vehicle 26, including the front 76 or any locations 78, 80, 82 and 84 of the side of the vehicle 26.

Figure 34:
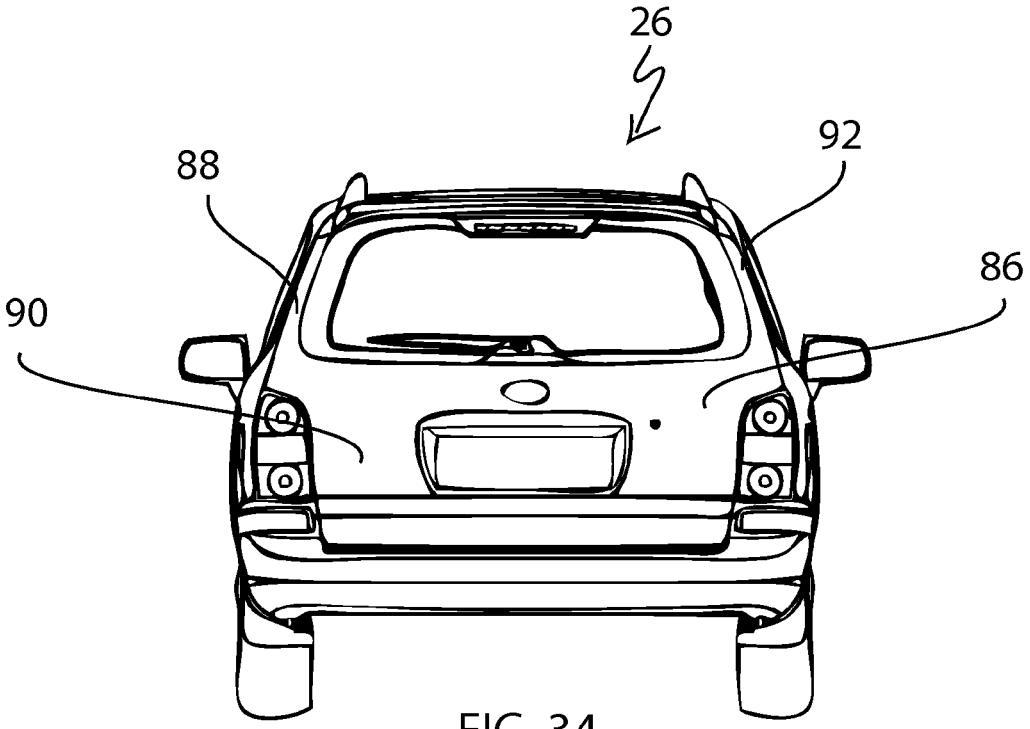
FIG. 34 illustrates a rear view of the vehicle.

As shown in FIG. 34, the magnetic flag 20 can be placed on any location 86, 88, 90 and 92 on the rear of the vehicle 26. Although specific locations 76, 78, 80, 82, 84, 86, 88, 90 and 92 have been illustrated, it is to be understood that the magnetic flag 20 can be located anywhere on the vehicle 26. Additionally, the magnetic flag 20 can be positioned either vertically or horizontally.

The magnetic flag 20 displays a graphic image or visual message in a non-permanent re-usable manner on the vehicle 26 or other magnet attracting surfaces and/or objects, including stationary objects, such as refrigerators, buildings or metal poles.

At least one edge 35, 48 and 50 of the flexible material 22 is free and not secured to the object, which allows the flexible material 22 of the magnetic flag 20 to move during movement of the vehicle 26 or object, which can generate additional attention to the graphic or written message displayed on the magnetic flag 20. However, the magnetic flag 20 lays flat against the vehicle 26 during use and does not impede or diminish visibility. As the magnetic flag 20 is attached by at least one magnet 42, the magnetic flag 20 can be removed and replace as needed in different locations without affecting the strength of the at least one magnet 42. The magnetic flag 20 does not require messy adhesives and is safe for use.

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

What is claimed is:

1. A magnetic flag comprising:

a piece of flexible material having a first edge and an opposing second edge, wherein a portion of the flexible material defines a pocket, and the pocket is proximate to the first edge of the piece of flexible material;

at least one magnet located in the pocket, wherein the at least one magnet removably attaches the pocket of the piece of flexible material to an object, and the opposing second edge is unattached to the object; and a spine having at least one recess, wherein the at east one magnet is received in the at least one recess, and the spine is located in the pocket.

2. The magnetic flag as recited in claim 1 wherein the piece of flexible material is fabric.

3. The magnetic flag as recited in claim 1 wherein a strip of non-skid material is attached to the pocket and contacts the object.

4. The magnetic flag as recited in claim 1 wherein a cover encases the at least one magnet in the spine.

5. The magnetic flag as recited in claim 1 wherein the at least one magnet has a width and the pocket has a width, and the width of the at least one magnet is less than the width of the pocket.

6. The magnetic flag as recited in claim 1 wherein the at least one magnet comprises a plurality of individual and separate magnets.

7. A magnetic flag comprising:

a piece of fabric having a first edge and an opposing second edge, wherein a portion of the piece of fabric defines a pocket, and the pocket is proximate to the first edge of the piece of fabric;

a plurality of magnets located in the pocket, wherein the plurality of magnets removably attach the pocket of the piece of fabric to an object, the opposing second edge is unattached to the object, and the plurality of magnets have a width and the pocket has a width, and the width of each of the plurality of magnets is less than the width of the pocket; and a spine having at least one recess, wherein each of the plurality of magnets is received in one of the at least one recess, and the spine is located in the pocket.

8. The magnetic flag as recited in claim 7 wherein a strip of non-skid material is attached to the pocket and contacts the object.

9. The magnetic flag as recited in claim 7 wherein a cover encases the plurality of magnets in the spine.

10. A magnetic flag comprising:

a piece of flexible material having a first edge, an opposing second edge and an attachment area located near the first edge;

at least one magnet located near the first edge of the piece of flexible material in the attachment area, wherein the at least one magnet removably attaches the attachment area of the piece of flexible material to an object, the opposing second edge is unattached to the object, and the at least one magnet has a width and the attachment area has a width, and the width of the at least one magnet is less than the width of the attachment area; and a spine defined by a first spine section including at least one recess and a second spine section, wherein the at least one recess receives the at least one magnet, the second spine section encases the at least one magnet between the first spine section and the second spine section, and the attachment area of the flexible piece of material is positioned between the spine and the object.

11. The magnetic flag as recited in claim 10 wherein the piece of flexible material is fabric.

12. The magnetic flag as recited in claim 10 wherein the at least one magnet comprises a plurality of individual and separate magnets.

13. A magnetic flag comprising:

a piece of flexible material having a first edge, an opposing second edge and an attachment area located near the first edge;

at least one magnet located near the first edge of the piece of flexible material in the attachment area, wherein the at least one magnet removably attaches the attachment area of the piece of flexible material to an object, the opposing second edge is unattached to the object, the at least one magnet has a width and the attachment area has a width, the width of the at least one magnet is less than the width of the attachment area, the attachment area defines a pocket, and the at least one magnet is located in the pocket; and a spine having at least one recess, wherein one of the at least one magnet is received in each of the at least one recess, and the spine is located in the pocket.

14. The magnetic flag as recited in claim 13 wherein a strip of non-skid material is attached to the pocket and contacts the object.

15. The magnetic flag as recited in claim 13 wherein a cover encases the at least one magnet in the spine.

16. A magnetic flag comprising:

a piece of flexible material having a first edge, an opposing second edge and an attachment area located near the first edge;

at least one magnet located near the first edge of the piece of flexible material in the attachment area, wherein the at least one magnet removably attaches the attachment area of the piece of flexible material to an object, the opposing second edge is unattached to the object, the at least one magnet has a width and the attachment area has a width, and the width of the at least one magnet is less than the width of the attachment area; and a first spine section and a second spine section including at least one recess that receives one of the at least one magnet, wherein the first spine section is positioned on a front side of the attachment area of the piece of material and the second spine section and the at least one magnet are located on a rear side of the attachment area of the piece of material that contacts the object.

17. The magnetic flag as recited in claim 16 wherein the first spine section and the second spine section are laminated together.

* * * * *